United States Patent [19]

Ness et al.

[11] Patent Number: 4,934,561

[45] Date of Patent: Jun. 19, 1990

[54] CONTAINER DISCHARGE APPARATUS AND METHOD EMPLOYING MICROWAVES

[75] Inventors: John B. Ness, Brisbane, Australia; John E. Althaus, 8 Fitzroy Street, Clayfield, Brisbane, Queensland, Australia, 4011

[73] Assignee: John E. Althaus, Pullenvale, Australia

[21] Appl. No.: 239,954

[22] PCT Filed: Dec. 22, 1986

[86] PCT No.: PCT/AU86/00391

§ 371 Date: Jun. 24, 1988

§ 102(e) Date: Jun. 24, 1988

[87] PCT Pub. No.: WO87/03865

PCT Pub. Date: Jul. 2, 1987

[30] Foreign Application Priority Data

Dec. 24, 1985 [AU] Australia ..... PH4028
Aug. 21, 1986 [AU] Australia ..... PH7583

[51] Int. Cl.[5] ..... B67D 5/62

[52] U.S. Cl. ..... 222/1; 222/146.5; 219/10.55 A; 219/10.55 M; 333/241

[58] Field of Search ..... 222/146.2, 146.5, 52; 219/10.55 R, 10.55 A, 10.58 F, 10.55 M; 333/241

[56] References Cited

U.S. PATENT DOCUMENTS

| | | | |
|---|---|---|---|
| 3,606,095 | 9/1971 | Konseder | 222/146.5 |
| 4,324,965 | 4/1982 | Naumann et al. | 219/10.55 M |
| 4,330,698 | 5/1982 | Sawada et al. | 219/10.55 M |
| 4,429,290 | 1/1984 | Devan | 333/241 |
| 4,534,493 | 8/1985 | Sedran | 222/146.2 |
| 4,621,179 | 11/1986 | Kusunoki et al. | 219/10.55 A |
| 4,684,776 | 8/1987 | Heard | 219/10.55 M |
| 4,710,736 | 12/1987 | Stidwell | 333/241 |
| 4,778,970 | 10/1988 | Klaila | 219/10.55 A |

FOREIGN PATENT DOCUMENTS

| | | | |
|---|---|---|---|
| 56800/86 | 4/1986 | Australia . | |
| 2414895 | 10/1975 | Fed. Rep. of Germany | 222/146.5 |

*Primary Examiner*—F. J. Bartuska
*Assistant Examiner*—Steven Reim
*Attorney, Agent, or Firm*—Foley & Lardner, Schwartz, Jeffery, Schwaab, Mack, Blumenthal & Evans

[57] ABSTRACT

Apparatus and method for enabling viscous fluids to be discharged from a container. The container is provided with an outlet positioned for gravity discharge of the contents. Microwave energy is delivered to an inlet opening of the container for the purpose of heating the stored fluids in a controlled area which includes the inlet and outlet. The microwave energy is effective to heat the viscous fluids to a flowable state while fluids are simultaneously discharged from the outlet. The energy level can be controlled based on the level of viscous fluid in the tank so that the viscous fluid is not overheated.

20 Claims, 6 Drawing Sheets

FIG 11
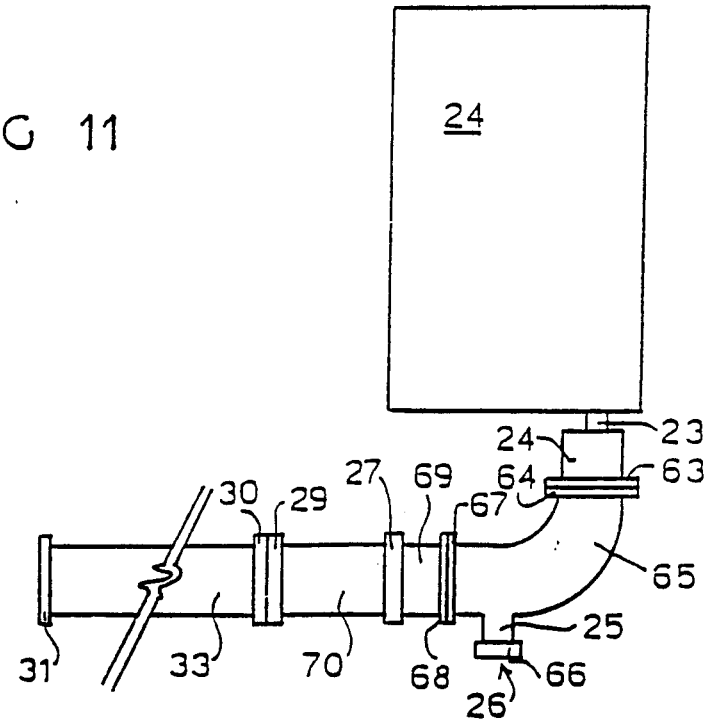
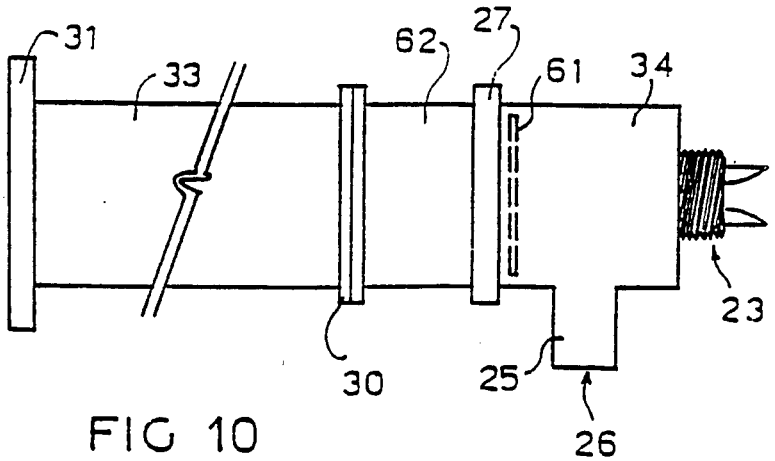
FIG 10

CONTAINER DISCHARGE APPARATUS AND METHOD EMPLOYING MICROWAVES

TECHNICAL FIELD

This invention relates to a method of discharging containers having a viscous or solid material stored therein which may only be effectively discharged by raising its temperature to cause to flow freely. The invention also proposes apparatus whereby the method of the invention may be put into effect.

BACKGROUND ART

There are a number of industries which depend upon the storage of raw materials for transport and later discharge at processing centres, which materials are of a character that requires expensive and inefficient processes to remove the material from its container.

In the honey industry, producers ship their honey to a few centrally located process plants for packaging for retailing. Honey is a supersaturated solution in which the dextrose component will crystallise in the presence of impurities providing nuclei for crystal formation. The impure nature of the produce, and the vibration attendant to transport, usually results in the honey which is delivered to a processing plant being in a solidified state. If containers are to be reused so as to reduce costs, and if the honey is to be processed and bottled, it must be first liquified to remove it from its shipping containers. Liquidification usually takes place by storing the containers at an elevated temperature for times sufficient for the crystallised sugar to go back into solution. The energy comsumption required at this stage of processing is considerable. Present techniques are wasteful and a more efficient process is desirable.

Another material which is transported in quantity ,and which will solidify in the process, is tallow. To effect discharge, containers have been devised with heating coils to maintain the tallow in a liquid state but these are expensive.

Bitumen is a highly viscous material which may only be removed effectively from its containers by heating to temperatures in the vicinity of 200 C. Other viscous liquids which are commonly transported, and are heated to effectively remove them from their transport containers, are molasses, coconut oil, paints and resins.

The usual container employs a metal casing with a discharge outlet. If a viscous material in the simplest of containers, such as the common '44 gallon' drum, is to be heated, hot rooms, hot baths, thermal jackets, must be provided, with the capacity to receive one or more containers therein. Where heat is provided in this way, externally, the size of the container is limited by practical considerations associated with its movement. The container size might be readily increased with provision of internal heat exchange structures. The latter development raises the costs of the containers, and practice indicates that the lifetime of the container is reduced by association of the additional elements, and that there are more complex problems in the cleaning of the containers.

OBJECT OF THE INVENTION

It is an object of the present invention to provide a method and means whereby existing containers may be more effectively emptied than has hitherto been possible, without the need of the usual external heating means, and whereby the internally established heat exchanges of larger containers may be dispensed with, so that large volume, simply structured storage containers may be utilized and discharged in a manner which is more effective and more energy efficient than previously. Other objects and advantages of the invention will hereinafter become apparent.

The present invention achieves its objects by a method of discharging a viscous liquid from a container therefor wherein the container is oriented so that an outlet thereto is so located as to permit gravitational flow of the viscous fluid therefrom, characterised by:

coupling a microwave source to an inlet opening in the container;

injecting microwave energy via the inlet opening so as to effect heating of the viscous fluid within the container, reduce its viscosity, and thereby increase the rate of fluid flow out of the container; and controlling the microwave source so as to regulate the flow of fluid from the container. The invention proposes a discharge apparatus whereby viscous fluids are enabled to flow from a container therefor characterised by:

a source of microwave energy including a microwave generator and a power supply thereto, to inject microwave energy into a waveguide;

a waveguide to transmit microwaves injected therein by the source of microwave energy to a container to be discharged; and a coupling means whereby the waveguide may be releasably coupled to an inlet opening of a container to be discharged so that microwaves directed thereto along the waveguide are passed into the container to effect heating of a viscous fluid stored therein.

BRIEF DESCRIPTION OF THE DRAWINGS

So as to more clearly establish the character of the invention, it will now be more particularly described with reference to the accompanying drawings, in which:

FIGS. 10 and 11 illustrate alternate arrangements of the elements of a discharge apparatus in accordance with the present invention.

DETAILED DESCRIPTION OF THE PREFERRED EMBODIMENTS

Figure 1:
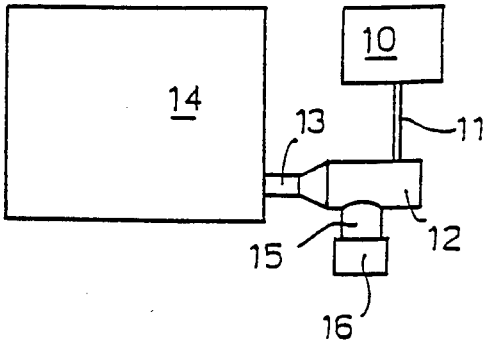
FIG. 1 illustrates the disposition of elements of a basic form of the discharge apparatus in accordance with the present invention.

In FIG. 1, a container 14 which is to be emptied of a liquid which requires heating so as to cause it to flow freely is shown laid on its side with its outlet opening lowermost. A coupling device 13, of which more is said below, may be screwed into the container outlet. Coupling device 13 connects with a liquid outlet 12 having a T-piece configuration, with a liquid discharge passage 15 through which fluid flowing out of container 14, through coupling device 13, may drain therefrom into whatever processing plant, secondary container etc., the container 14 is to be discharged to.

The liquid outlet 12 provides for the injection of microwave energy through coupling device 13 into container 14, to effect heating of the contents therein. In order to provide microwave energy, a microwave generator 10 may feed microwaves via a suitable coupling 11 into liquid outlet 12.

In order that microwave energy is not able to feed out of discharge passage 15, a microwave filter 16 may be applied to the end thereof. The component elements of such a filter are discussed below.

In developing an apparatus of the above kind, the permitted frequencies which may be employed are set by regulation, such that the working geometries are narrowly constrained. The usual, standard containers, the '44 gallon' and '4 gallon' drums, are provided with discharge openings which are inappropriate for feeding microwaves of the usually permitted wavelengths, being too small, given the wavelength of the microwaves to be fed into the container. This problem may be solved in a number of ways and one solution is set out below.

The microwave generator 10 may employ the usual magnetron manufactured for heating applications. The magnetron might be directly mounted onto the liquid outlet 12, to inject energy therein, or it may be provided remotely, to be coupled to the liquid outlet 12 via a coaxial cable feeding power to an injection device in the liquid outlet 12. As the magnetron requires cooling, its component structures are both heavy and cumbersome for direct mounting to the liquid outlet 12, such that its incorporation in a remote unit is that way preferable. For some applications, the need for high energies such as with large volume drums, and the problems of suitably matching a train of microwave transmission components, may make the direct mounting of the magnetron to the liquid outlet desirable so as to simplify the coupling problems.

Where a remote microwave generator is possible, it might be disposed in a movable cabinet. The liquid outlet can then be a relatively simple structure easily handled and screwed into a container outlet, following which a standard coaxial cable hookup can be effected to establish the means for microwave injection.

In order to obtain higher microwave energies, more than one generator might be coupled to the liquid outlet 12. Consideration needs be given to preventing unwanted cross coupling of multiple sources. Crossed fields will enable two generators to effectively feed microwaves into a container. As the magnetron output is pulsed with considerable pulse spacing, the timing of the pulse trains of two magnetrons may be adjusted so as to not overlap.

The liquid outlet 12 may be a T-piece structure, with the cap of the T-piece being dimensioned to transmit microwaves from an injection point towards the container 14. Where the container 14 is a custom built structure, the T-piece transmission channel may feed straight into the container through a like sized opening. Otherwise a coupling device as in FIG. 4 is used.

Figure 2:
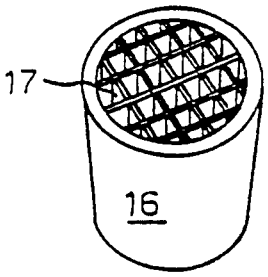
FIG. 2 shows the structure of a filter.

In FIG. 2 is shown a filter 16 which may be applied to the end of outlet 15. This may be provided with a network of crossed plates 20 to partition to outlet for liquids, to allow fluid flow through an outlet structure having passages too small for microwave transmission at the wavelength being employed. It will be clear to persons in the art that the size and length of the partition may be chosen to suit whatever minimum leakage that prevailing standards permit.

Figure 3:
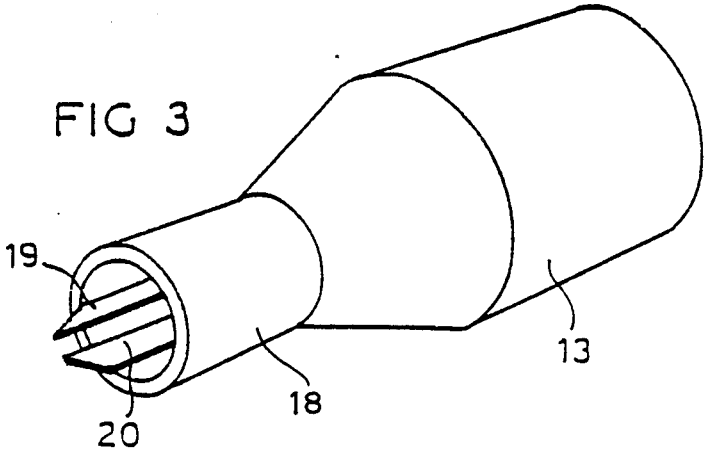
FIG. 3 shows a coupling device.

In FIG. 3 is shown a coupling device 13 which may be used to couple a liquid outlet 12 into a container with a too small opening, having regard to the wavelength of the microwaves that are to be passed therethrough. A sleeve 13 is provided for fitting into the outlet T-piece, and a screw threaded neck 18 is provided for screwing into a container outlet. Where the narrow neck 18 and its length are such as to reflect microwaves rather than transmitting them, any of the standard techniques which promote transmission may be applied. In FIG. 3 the orthogonal plates quartering the opening operate to achieve this effect.

Figure 4:
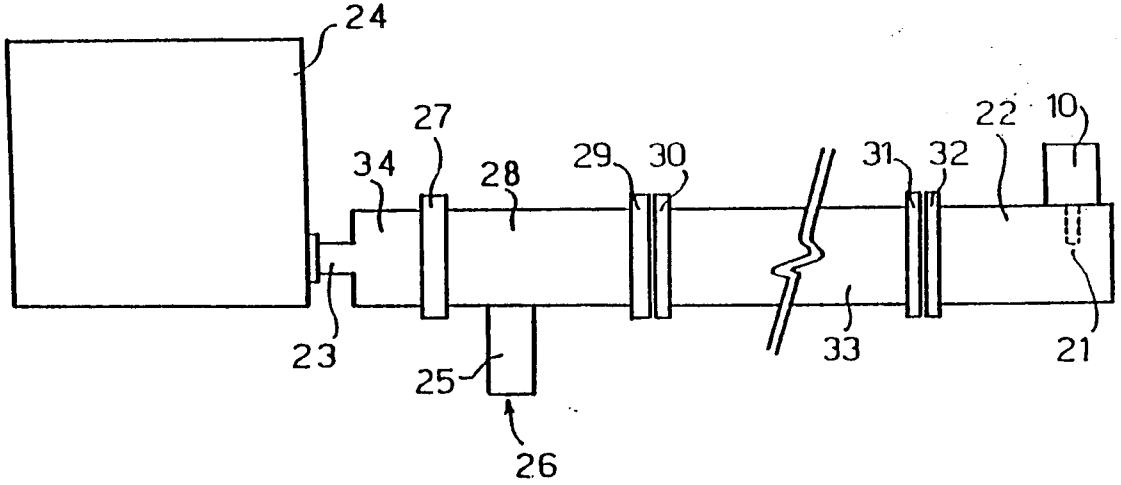
FIG. 4 illustrates the disposition of elements of a discharge apparatus in accordance with the present invention.

In FIG. 4 a container 24 that is to be emptied and needs its contents to be heated so as to cause the contents to flow, is shown tipped on its side with its outlet at a lowermost point. A coupling device 23, which is described in greater detail below, is screwed into the outlet of container 24. Coupling device 23 connects with a liquid outlet piece 28 having a T-piece configuration with an outlet pipe 25 communicated thereto with an opening therefrom at 26. Fluid from container 24 is able to flow out the container outlet via coupling device 23, through outlet piece 28 to outlet pipe 25 to be discharged at 26. This operation will be described in greater detail below. The fluid flowing from 26 may be fed to another container or into a processor, etc. The outlet piece 28 provides for the injection of microwave energy through the coupling device 23 into container 24, to effect heating of the contents therein. In order to provide microwave energy, a microwave generator 10 is provided to feed microwaves axially through the outlet piece 28 towards the container opening.

In order that microwave energy is not able to feed out of the discharge opening 26, a microwave filter may be applied to the outlet pipe 25.

In FIG. 4 a magnetron 10 is coupled to a wave guide section 22 via a coupling element 21 of any of the standard forms. In order that the magnetron 10 and its associated power supplies and cooling systems may be conveniently housed at a remote unit, the wave guide section 22 is coupled to the outlet piece 28 via a flexible waveguide 33 which may be a length of metal piping of the type which is formed from a helical overlapped coil in which adjacent coils are axially slidable to a degree in the fashion of male female connecting elements so as to enable a degree of bending. This allows the magnetron unit to be provided in a separate unit readily coupled to a drum without regard to mutual placement. In FIG. 4, the flexible waveguide 33 may be coupled to wave guide section 22 and outlet piece 28 by flange connector pairs 29, 30 and 31, 32 that are bolted together in use. So as to couple outlet piece 28 to coupling device 23, a locking ring 27 may be provided as will. become more clear below.

Where the container 24 is a custom built structure, the T-piece outlet 28 may feed straight into the container through a like sized opening. Otherwise a coupling device as in FIGS. 6 and 7 is used.

Figure 5:
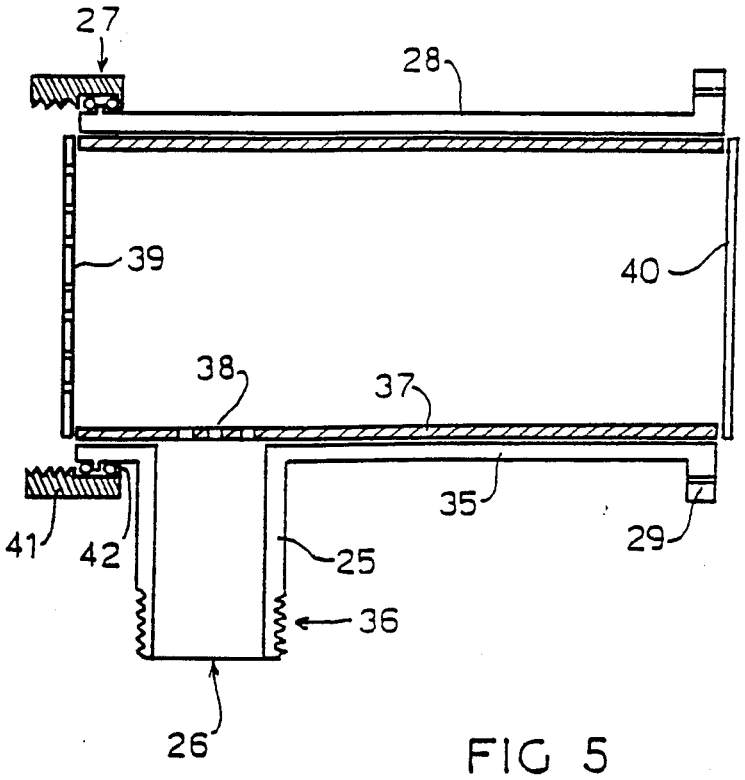
FIG. 5 illustrates the component parts of a liquid outlet which might be employed in the apparatus of FIG. 1.

In FIG. 5, the outlet piece 28 is constructed with an outer cylindrical body part 35 which carries the end connection flange 29 and the outlet pipe 25 with discharge opening 26 and a threaded end 36 to which any desired pipe, spout, etc. may be attached. So that the bore of the body part 35 is seen by the microwaves to be uniform therealong, and so as to preclude the possibility of microwave energy from being fed out outlet pipe 25, an inner sheath 37 is formed with a pattern of small holes at 38 over the outlet pipe 25 which allow liquid flow therethrough but block microwaves. At the forward end where locking ring 27 couples into a container, a plate 39 may be provided. This plate may be apertured to allow fluid flow and is provided of a material which is transparent to the passage of microwaves. This will act to prevent any material that might block the outlet pipe holes 38 from reaching that point. At the rear end, a plate 40 may be provided that is transparent to microwaves and is not apertured so as to block flow of any material that has not flowed out outlet 26 from flowing back up the waveguides. Locking ring 27 comprises a threaded ring 41 on a ball bearing structure 42 about body part 35.

Figure 6:
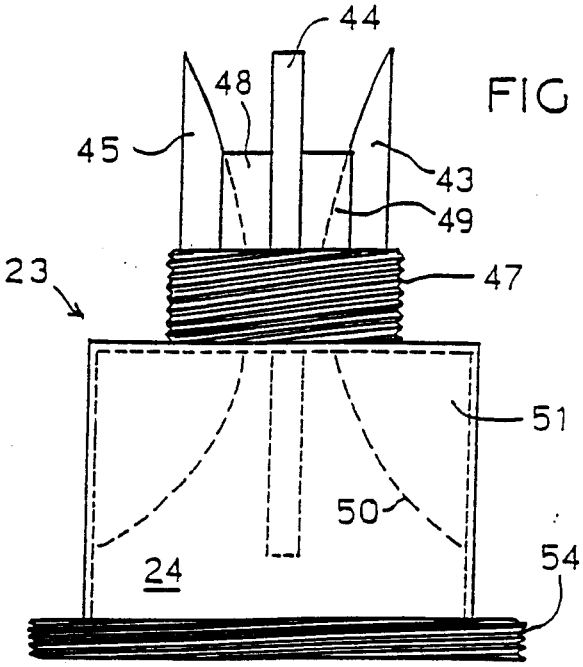
FIGS. 6 and 7 show a coupling device whereby the liquid outlet of FIG. 5 may be coupled to a container that requires emptying.
Figure 7:
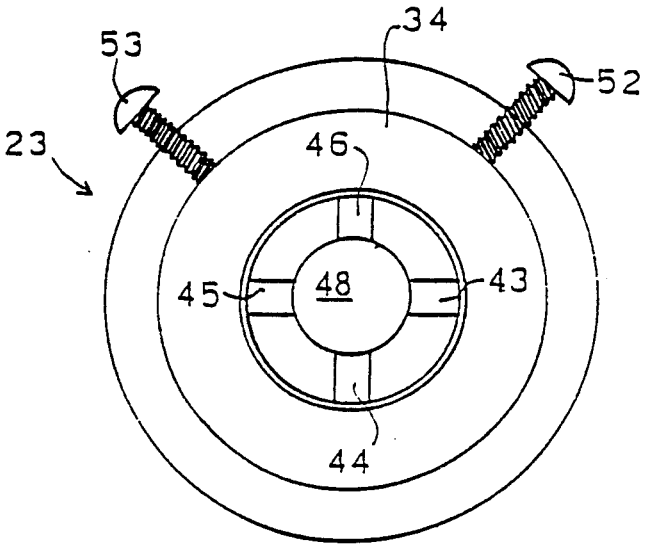

In FIGS. 6 and 7 is shown a coupling device 23 which may be used to couple a liquid outlet of a container with too small an opening, having regard to the wavelength of the microwaves that are to be passed therethrough, to the outlet piece 28. The problem here is how to get microwave energy at the permitted wavelengths through the small outlet holes of standard containers. Microwave energy at a frequency of 2.450 GHz will be reflected by a hole of 50 mm diameter rather than propagated therepast. Some means is required to propagate the 2.450 GHz microwaves past the 50 mm diameter hole of an outlet tube that is typically 20 mm long to carry the capping thread. Besides getting the energy through, several other specifications ought to be met. These are:

(1) The transition should be well matched (that is, the energy reflected should be a minimum).

(2) The transition must act as a transforming section between the 100 mm circular waveguide employed in this embodiment to carry the 2.450 GHz microwaves and the interior of the drum.

(3) As described below, ideally, there are two independent orthogonal waveforms in the 100 mm waveguide. The transition must act as a transforming unit for each wave with minimum coupling between the two waves.

(4) The transition must handle high power with no arcing or burning of dielectric material employed in the coupling.

(5) Impediments to the flow of viscous material should be kept to a minimum.

(6) The transition should be relatively independent of the material being heated.

The construction of the coupling device 23 is based upon the principle of using a ridged waveguide to reduce the cut-off frequency of the guide. In the coupling device 23 the threaded neck section 47, which is threaded into a complementary container opening of similar length, is provided with waveguide ridges 43 to 46, disposed as shown to provide a dual ridged structure for the transmission of orthogonal modes in the circular guide 34. A dielectric insert 48 assists in further reducing the cut-off frequency of the ridged section. It, more importantly, serves to keep lossey material, that could burn, out of the high field region across the ridged sections. The ridges are curved as at 49 and 50 on ridge 43 to provide a smooth transition between the waveguide sections. The ridge is joined, as at 51 on ridge 43, to the waveguide walls so as to be well connected there to avoid arcing problems. The orthogonally mounted ridged waveguide sections 43 to 46 and dielectric insert 48 serve to meet the needs of objective 1 to 6 set out above. Tuning screws 52 and 53 may be provided so as to assist in achieving optimum operation.

In FIGS. 6 and 7, the dielectric insert 48 is a cylindrical block arranged coaxially of threaded section 47 with space thereabout for fluid flow there -past. The dielectric insert is bonded to the waveguide ridges to be an integral part of the structure. The waveguide section 34 is provided with a threaded flange 54 by which the coupling device 23 may be attached to the outlet piece 28 with the locking ring 27 of that part screwed onto the threaded flange 54 to lock the two units together.

Figure 8:
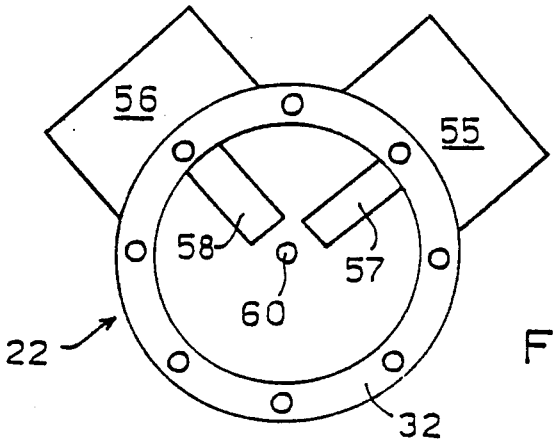
FIGS. 8 and 9 show a microwave propagator for use in the system of FIG. 1.
Figure 9:
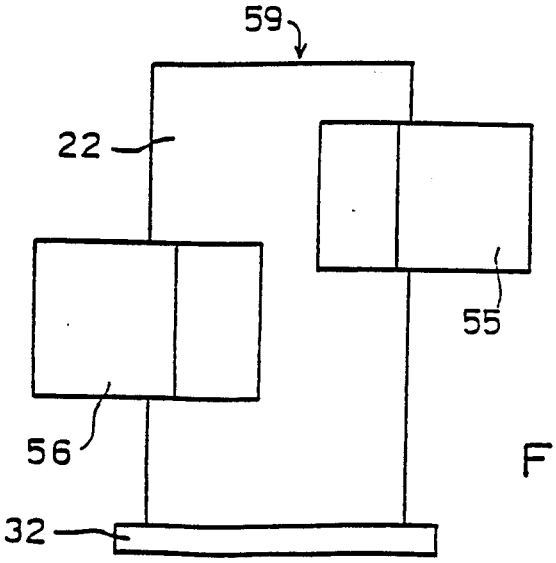

FIGS. 8 and 9 illustrate schematically the characteristic features of a microwave propagator in which waveguide section 22 has two orthogonally mounted magnetrons 55 and 56 thereon, each feeding microwave energy to respective injectors 57 and 58 of standard form which are orthogonally aligned so that each may simultaneously feed microwaves into the waveguide and thereby double up the available power. The wave guide section 22 has a blank end 59. With a 2.450 GHz system and a circular 100 mm diameter waveguide, the injector 57 is positioned 56.5 mm from the blank end 59 and injector 58 is 146.5 mm from the blank end. The power in the guide may cause ionisation and to prevent this adverse occurrence, a flow of air through the guide may be developed. The cooling fan (not shown) to one of the magnetrons may also feed air to a small tube opening into the wave guide section forward of the injector 58 with a hole 60 at the rear wall 59 to exhaust the air from within the wave guide section. A small flow of air may be effective to eliminate problems in this area. Flange 32 provides a means whereby the microwave propagator may be coupled into the rest of the system.

The function of the described apparatus is to feed microwaves into a container to be discharged, wherein the contents absorb the energy in a dielectric heating process whose effect is to liquify the solid or viscous material therein so that it will flow out the container outlet, along the T-piece cap and down the T-piece leg to be discharged. As the liquified material is flowing one way along the device, oppositely to the transmission of microwaves, the liquid temperature is maintained. So that the temperature is not unduly raised, the length of the component parts needs be restricted to a minimum so that discharge from the microwave field is achieved as quickly as possible.

With a full container, the action of the apparatus will be to melt a cavity into the material therein as, at the wavelengths permitted for this operation, heating occurs within the surface layers first met by the waves entering the container. Liquification will occur off the surface layer of the cavity, with liquid draining downwards and out the outlet with the cavity growing in size until the container is emptied. So as to continue the process until a container is exhausted, the power fed to the container will need to be sufficient to continue the heating to liquification temperatures at the larger surface areas achieved as the container nears exhaustion. As this energy level may overheat the material at the initial stages, whereat the surface area of the cavity is small, consideration may be given to continuously controlling the level of power being fed. Temperature considerations are important with materials such as honey which may separate to leave the dextrose in the container, and will scorch with overheating. Larger containers might be exhausted by operation of a plurality of microwave discharge devices of the type outlined above, each opening into the containers at a plurality of points, with individual cavities growing to merge and exhaust the container.

Whilst the above described apparatus is designed for application to existing containers having a single circular outlet, where custom made containers are produced, other geometrics may become feasible. The injection channel for microwaves and the outflow for liquid might be separated in a double barrelled over and under configuration, with liquids flowing out the bottom of a liquified cavity through an outlet below the microwave inlet. The feeding of liquid up the microwave channel might be prevented by simply angling it slightly downwards against the gravitational flow of liquid. Or the two channels might be interconnected by a downpipe similar to the T-piece leg described above.

In order that both custom built containers and the standard storage drums might be exhausted by the same discharge apparatus, a container coupling device can be developed with a two part construction wherein the dimensions required for smaller openings are provided by a first component which, when a larger opening is to be coupled, is fitting into a second component which provides for coupling into the larger opening.

The coupling device of FIG. 3 might be modified with coaxial cable being fed up the liquid outlet tube to a device, mounted in the coupling device, which operates to inject microwaves directly into the container. In this way, the problem of how the longer wavelength microwaves are to be fed through a too small container opening is solved. In order that the microwave energy fed to the coaxial cable be injected into the drum, a suitable propagator or probe might be mounted at the inner end (in the sense of the container) of a coupling device. The forms which the probe may take will be clear to persons skilled in the art. By feeding power via a coaxial cable up to the container opening, the problem of outflowing liquid being progressively heated by microwaves travelling up the liquid outlet is overcome.

The method of the present invention involves the injection of microwaves into a container having solid or viscous substance therein which absorbs microwaves of a preselected wavelength so as to be heated thereby at the surface layer exposed to the microwaves. The heating of the material at its exposed surface will result in a liquification or lower viscosity so as to enable efficient flow out the container outlet with a cavity being formed thereabout as the injected microwaves melt a continuously enlarged hole into the material. The time to heat the material to a point at which a flow is obtained out the container is reduced compared to other techniques where usually the whole body of material must be supplied with heat sufficient to achieve a flow before emptying of the container can begin. With all the heating energy injected into the material to melt it from the inside out, a more energy efficient process of discharging containers is created. Adoption of the present technique will allow a progressive discharge with no useless loss of energy. Where a container is required to be only part exhausted, with some material retained for latter use, the present invention enables this to be done. With prior techniques, the whole, or substantial amounts of the material need to be heated to obtain an outflow. Where a container need only be half emptied all its contents are heated and the heat retained by the material left in the container for future use is lost.

In FIG. 10, the outlet 25 has been moved, to become a feature of the coupling device 23, being provided out the side of wave guide section 34 which may be closed off at its rear end by a teflon or other microwave transmissive plate 61 so as to block material flow back up the wave guide system. This disposition moves the outlet closer to the container so that the liquified material is in the microwave field for less time. A coupling tube 62 may be provided so as to enable use of the flexible guide 33 of FIG. 4. The coupling tube 62 may have an end flange for connection with tube 62 of the Connex type. Its other end may carry a screw coupling 27 for engagement with a screw thread on coupling device 23. This arrangement enables the coupling device 23 to be screwed into a container opening, and a flexible waveguide 33, with Connex flanges, to be attached thereto.

In FIG. 11 is shown an arrangement wherein a container 24 may be upended for emptying. Coupling device 23 is joined to a curved section 65 with outlet 25 therein for outflow of material. Outlet 15 may be provided with a filter 66. The curved section 65 and coupling device 23 may be united with Connex flange connectors 63, 64. A section 69 may be provided with a screw end for coupling to a tuning section 70 having a coupling ring 27 for screwed engagement with section 69 which is fitted to curved section 65 via a Connex coupling 67, 68. Tuning section 69 may be coupled to flexible section 33 by Connex couplings 29, 30.

Whilst the above has been described with reference to preferred embodiments it will be clear that many modifications and variations may be made thereto that are within the scope and spirit of the invention.

We claim:

1. A discharge apparatus whereby viscous fluids are enabled to flow from a container therefor characterised by:

a source of microwave energy including a microwave generator and a power supply thereto, to inject microwave energy into a waveguide;

a waveguide to transmit microwaves injected therein by the source of microwave energy to a container to be discharged; and coupling means for releasably coupling the waveguide to an inlet opening of a container to be discharged so that microwaves directed to said coupling means along the waveguide are passed into the container to effect heating of a viscous fluid stored therein, said coupling means providing a combined inlet for microwave energy and an outlet for fluids flowing from the container, and comprising a waveguide section which is terminated at one end by a releasable securing means whereby the waveguide section may be coupled to the inlet opening of the container, the other end of said waveguide section being connectable to the waveguide, said waveguide section having an outlet for fluid in a wall thereof, said outlet being screened against the passage of microwaves therethrough. other end, and wherein a teflon screen with apertures sized to permit the flow of the fluid is provided across said one end.

2. The discharge apparatus as claimed in claim 1, wherein said releasable securing means comprises a screw threaded retaining ring that is rotatable mounted on said one end of the waveguide section and a coupling unit between the container and the waveguide to which the threaded retaining ring is screwed in use.

3. The discharge apparatus as claimed in claim 2, wherein said coupling unit comprises a screw threaded neck for screwed attachment to a container opening joined end to end with a body part having a cross section matching that of the waveguide section, and propagation means being provided therein whereby microwaves passed therealong are transmitted past the neck into the container.

4. The discharge apparatus as claimed in claim 3, wherein the propagation means comprises four orthogonally positioned conductive ridges internally of the neck which extend outwardly of the neck as tapered projections and inwardly into the body part where the ridges are joined to the wall of the body part, and a dielectric insert provided between the ridges axially of the neck and radially spaced therefrom to permit fluid flow.

5. The discharge apparatus as claimed in claim 1, wherein a teflon baffle plate is provided across said other end, and wherein a teflon screen with apertures sized to permit the flow of the fluid is provided across said one end.

6. A discharge apparatus whereby viscous fluids are enabled to flow from a container therefor characterised by:

a source of microwave energy including a microwave generator and a power supply thereto, to inject microwave energy into a waveguide, said source of microwave energy comprising a length of waveguide with two magnetrons supported therein, each magnetron including an injector which is orthogonally aligned and spaced apart with respect to the other injector and with respect to a blank end wall, along the axis of the length of waveguide, and further including means for producing an air stream through the length of said waveguide;

a waveguide to transmit microwaves injected therein by the source of microwave energy to a container to be discharged; and coupling means for releasably coupling the waveguide to an inlet opening of a container to be discharged so that microwaves directed thereto along the waveguide are passed into the container to effect heating of a viscous fluid stored therein.

7. A method of discharging a viscous liquid from a container therefor wherein the container is oriented so that a fluid outlet thereof is so located as to permit gravitational flow of the viscous fluid from said container, comprising the steps of:

coupling a microwave source to an inlet opening in the container, said inlet opening also constituting said fluid outlet, injecting microwave energy via the inlet opening so as to effect heating of the viscous fluid within the container, thereby reducing the viscosity of the fluid and increasing the rate of fluid flow out of the container; and controlling the microwave source so as to regulate the flow of fluid from the container without causing deterioration of the fluid.

8. A discharge apparatus whereby viscous materials made fluid by heating are enabled to flow from a container therefor characterised by:

means for supporting the container with its outlet positioned for gravitational outflow of its contents;

a source of microwave energy including a microwave generator and a power supply thereto, to inject microwave energy into a waveguide;

a waveguide to transmit microwaves injected therein by the source of microwave energy to a container to be discharged; and coupling means for releasably coupling the waveguide to an inlet opening of the container whose contents are to be partially or entirely discharged, so that microwaves directed to said coupling means along the waveguide are passed into the container to effect heating of the viscous material stored therein, the injection of microwaves being effective to heat the material to a fluid state for simultaneous discharge from the outlet.

9. The discharge apparatus as claimed in claim 8, wherein the coupling means provides a combined inlet for microwave energy and an outlet for fluids flowing from the container, the coupling means comprising a waveguide section which is terminated at one end by a releasable securing means whereby the waveguide section may be coupled to the inlet opening of the container, the other end of said waveguide section being connectable to the waveguide, said waveguide section having an outlet for fluid in a wall thereof, said outlet being screened against the passage of microwaves therethrough.

10. The discharge apparatus as claimed in claim 9, wherein said releasable securing means comprises a screw threaded retaining ring that is rotatable mounted on said one end of the waveguide section and a coupling unity between the container and the waveguide to which the threaded retaining ring is screwed in use.

11. The discharge apparatus as claimed in claim 10, wherein said coupling unit comprises a screw threaded neck for screwed attachment to a container opening joined end to end with a body part having a cross section matching that of the waveguide section, and propagation means being provided therein whereby microwaves passed therealong are transmitted past the neck into the container.

12. The discharge apparatus as claimed in claim 11, wherein said propagation means comprises four orthogonally positioned conductive ridges internally of the neck which extend outwardly of the neck as tapered projections and inwardly into the body part where the ridges are joined to the wall of the body part, and a dielectric insert provided between the ridges axially of the neck and radially spaced therefrom to permit fluid flow.

13. The discharge apparatus as claimed in claim 9, wherein a teflon baffle plate is provided across said other end, and wherein a teflon screen with apertures sized to permit the flow of the fluid is provided across said one end.

14. A discharge apparatus as claimed in claim 10, wherein a means is provided whereby an air stream is developed through the length of waveguide.

15. A discharge apparatus as claimed in claim 8, wherein the source of microwave energy comprises a length of waveguide with two magnetrons supported therein, each magnetron having an injector which is orthogonally aligned with respect to the other injector, said injectors being spaced apart with respect to each other and with respect to a blank end wall along the axis of the length of waveguide.

16. A method of discharging viscous material made fluid by heating from a container therefor wherein the container is oriented so that an outlet thereof is so located as to permit gravitational flow of the fluid therefrom, comprising the steps of:

coupling a microwave source to an inlet opening in the container;

injecting microwave energy via the inlet opening so as to effect heating of the viscous fluid within the container, reduce its viscosity, and thereby increase the rate of fluid flow out of the container, which flow occurs while microwave energy is being injected; and controlling the level of microwave energy injected from microwave source so as to regulate the flow of fluid from the container.

17. A method of discharging a container as claimed in claim 16, wherein two microwave generators are employed to inject microwave energy into the container through the same inlet along the same waveguide, the microwaves from the two generators being such that their respective fields are disposed orthogonally of each other, the fields being established by orthogonally placed probes spaced from a blank end wall to the waveguide.

18. A method of discharging a container as claimed in claim 16, wherein at least two microwave generators are employed to inject microwave energy into the container through the same inlet along the same waveguide, the generators being each operated in a pulsed regime, the injection of each pulse being timed so as not to overlap a pulse from another generator.

19. A method of discharging a container as claimed in claim 16, wherein four microwave generators are employed to inject microwave energy into the container through the same inlet along the same waveguide, the pulsed operation being employed in conjunction with an arrangement of generators such that where overlapping of pulses would otherwise occur the fields of the respective pulses are orthogonal with injection probes spaced from a blank end wall to the waveguide.

20. A method of discharging a container as claimed in claim 16, wherein the amount of microwave energy delivered to the container is controlled in such a way as to progressively increase as a cavity in the container is eroded.

* * * * *